US007810665B2

(12) United States Patent
Wriedt

(10) Patent No.: US 7,810,665 B2
(45) Date of Patent: Oct. 12, 2010

(54) SHIPPING CONTAINER

(75) Inventor: Karl-Heinz Wriedt, Rheine (DE)

(73) Assignee: BWH-Koffer-, Handels- und Vermögensverwaltungsgesellschaft m.b.H & Co. KG, Hörstel (DE)

( * ) Notice: Subject to any disclaimer, the term of this patent is extended or adjusted under 35 U.S.C. 154(b) by 428 days.

(21) Appl. No.: 11/886,273

(22) PCT Filed: Mar. 17, 2006

(86) PCT No.: PCT/EP2006/060826

§ 371 (c)(1),
(2), (4) Date: Sep. 13, 2007

(87) PCT Pub. No.: WO2006/097524

PCT Pub. Date: Sep. 21, 2006

(65) Prior Publication Data

US 2008/0164252 A1 Jul. 10, 2008

(30) Foreign Application Priority Data

Mar. 18, 2005 (DE) ..... 10 2005 013 097
Jun. 17, 2005 (DE) ..... 10 2005 027 994

(51) Int. Cl.
*B65D 88/00* (2006.01)

(52) U.S. Cl. ..... 220/1.5

(58) Field of Classification Search ..... 220/4.34, 220/4.33, 4.27, 4.26, 23.86, 328, 4.01, 4.17, 220/4.16, 4.12; 206/600, 519, 515, 507, 206/505, 503; 292/253, DIG. 53, DIG. 54, 292/DIG. 64; *B65D 21/08, 21/06, 21/036, B65D 21/032*

See application file for complete search history.

(56) References Cited

U.S. PATENT DOCUMENTS

| | | | | | |
|---|---|---|---|---|---|
| 1,437,812 | A | * | 12/1922 | MacMillan | 126/38 |
| 1,494,818 | A | * | 5/1924 | Shean | 220/4.17 |
| 2,346,445 | A | * | 4/1944 | Merker et al. | 217/107 |
| 2,561,979 | A | * | 7/1951 | George | 229/125.21 |
| 2,812,093 | A | * | 11/1957 | Podesta | 215/275 |
| 3,338,388 | A | | 8/1967 | Igoe et al. | |
| 3,642,166 | A | * | 2/1972 | Starr | 220/320 |
| 4,013,170 | A | * | 3/1977 | Hutterer | 206/521 |
| 4,048,050 | A | * | 9/1977 | Hillman | 206/1.5 |
| 4,105,013 | A | | 8/1978 | Vache | |
| 4,185,748 | A | * | 1/1980 | Vache et al. | 220/8 |
| 4,688,692 | A | * | 8/1987 | Humbs et al. | 220/3.8 |
| 4,721,205 | A | * | 1/1988 | Burt et al. | 206/317 |
| 4,746,008 | A | * | 5/1988 | Heverly et al. | 206/1.5 |
| 5,161,709 | A | * | 11/1992 | Oestreich, Jr. | 220/6 |
| 5,878,903 | A | | 3/1999 | Ung et al. | |

(Continued)

FOREIGN PATENT DOCUMENTS

DE 94 04 654 5/1994

(Continued)

*Primary Examiner*—Anthony Stashick
*Assistant Examiner*—Robert J Hicks
(74) *Attorney, Agent, or Firm*—Collard & Roe, P.C.

(57) ABSTRACT

A multi-use shipment container includes an upper part and a lower part, respectively, each provided with a bottom and walls and nesting together. To produce a shipment container that offers a high level of security and also can be handled securely, the parts can be locked in relation to each other at a plurality of locking points which are distributed over the periphery of the upper part or the lower part.

19 Claims, 12 Drawing Sheets

U.S. PATENT DOCUMENTS

Figure 1:
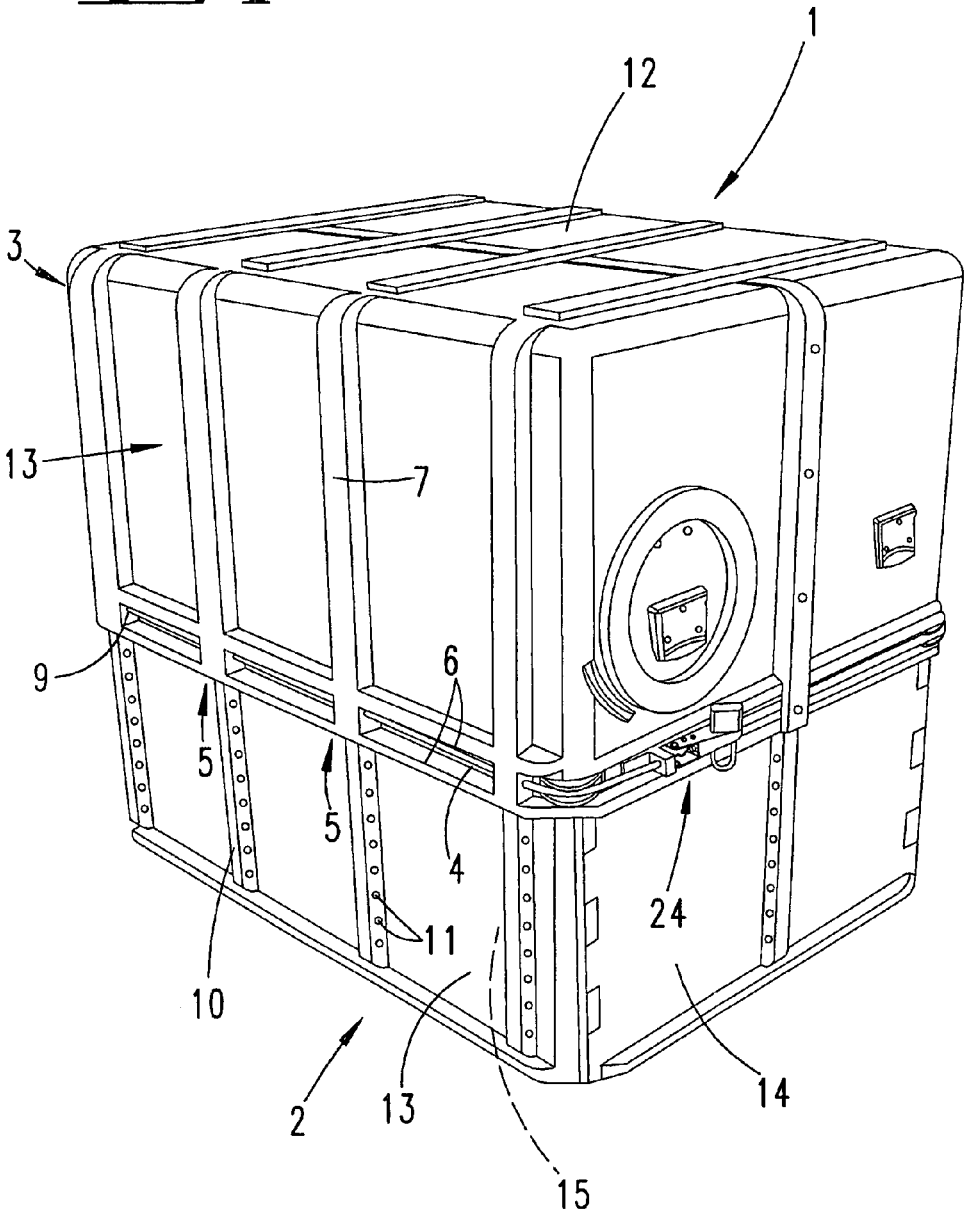

| | | | | |
|---|---|---|---|---|
| 6,786,346 | B1 * | 9/2004 | Gurnard et al. | 215/272 |
| 2006/0261059 | A1 * | 11/2006 | Jokinen | 220/1.5 |
| 2007/0034627 | A1 * | 2/2007 | Wood et al. | 220/23.91 |
| 2007/0170085 | A1 * | 7/2007 | Hoogland | 206/600 |

FOREIGN PATENT DOCUMENTS

| | | |
|---|---|---|
| EP | 0 016 977 | 10/1980 |
| EP | 1 433 710 | 6/2004 |
| FR | 2 397 334 | 2/1979 |

* cited by examiner

SHIPPING CONTAINER

CROSS REFERENCE TO RELATED APPLICATIONS

Applicant claims priority under 35 U.S.C. §119 of German Application No. 10 2005 013 097.6 filed Mar. 18, 2005, and German Application No. 10 2005 027 994.5 filed Jun. 17, 2005. Applicant also claims priority under 35 U.S.C. §365 of PCT/EP2006/060826 filed Mar. 17, 2006. The international application under PCT article 21(2) was not published in English.

The invention relates to a shipping container that can be used multiple times, having an upper part and a lower part having a bottom and walls, in each instance, whereby the parts are to be pushed into one another with the bottoms facing away from one another.

Such shipping containers are known, of course, for example as cartons made of a cardboard material. In this connection, the upper part and the lower part are wrapped with adhesive strips or cords. In most cases, they can only be used once. Their security, also with regard to handling, is very limited. In the present case, the primary concern is also shipping containers for larger goods, which are able to withstand rough stresses on the transport route, as well. In particular, what is involved is the shipping of goods stacked on pallets, or a shipping container that corresponds to such a pallet.

Proceeding from this goal direction, the invention sets itself the task of making available a shipping container that is as secure as possible and/or can be handled as securely as possible.

This task is accomplished, first of all and essentially in the case of the object of claim 1, whereby it is specified that the parts can be locked against one another at a plurality of locking locations, whereby the locking locations are disposed distributed on the circumference of the upper part and the lower part, respectively. Because of the fact that the parts of such a shipping container can be locked against one another at a plurality of locking locations, distributed over the circumference, a securely structured shipping container is obtained, which is also advantageous in its handling. The multiple locking procedures have to be carried out. Then the parts are held against one another so that they cannot come loose, and, if the material is selected appropriately, they are also sufficiently secure against impairment from the outside, or even attempts to break them open.

In the following, additional characteristics of the invention are described and explained, particularly in connection with the above combination of characteristics. However, these additional characteristics can also be of importance independently, in each instance.

Thus it is preferred that the locking locations are disposed assigned to a plane that extends perpendicular to a pushing direction. They are therefore disposed practically distributed on a horizontal line, in the state of the parts when they are pushed together.

Although an embodiment of such a shipping container made of a metallic material appears suitable in view of possible security, particularly security against being broken open, under certain aspects, it is currently preferred that the parts consist of a plastic material. A container formed from such a material, particularly if the material is processed using the deep-drawing method or plastic injection-molding method, for example, can in itself be structured to be stable and strong. However, it is important that it reacts to transport impairments such as being rammed with a forklift or falling from a certain height in such a resilient manner that recovery occurs, in other words no lasting deformations occur. If such a plastic is formed as a fiber-reinforced plastic, for example, it is clearly more difficult to cut it open or to penetrate into the container in some other destructive manner.

At the same time, plastic as a material is suitable for making the container relatively light, particularly also in view of its use as an air transport shipping container. This possible use is also of importance for other characteristics of the invention.

In another embodiment, it is preferred that molded projections that are oriented in accordance with the pushing direction and engage on top of one another are provided on both parts, which have locking recesses that match one another. In this way, a locking opening occurs by pushing the parts over one another, through which a locking element is to be inserted, and with which locking is then achieved. The locking recesses are accordingly also oriented preferably crosswise to the pushing direction. And furthermore in the circumference direction of the container.

One of the aforementioned molded projections can be structured, for example, by means of a bar part that is set onto a wall. This bar part, which can, at the same time, have a reinforcing effect, particularly in the vertical direction, can itself be formed as a plastic part, preferably as an essentially solid plastic injection-molded part, except for the locking recesses, but also as a metal part. On the other hand, the molded projection can also be formed in the wall, as an integral part of it. It is preferred that in the case of the one part, for example the lower part, the molded projections are formed as bar parts, while in the case of the other part, here the upper part, they are formed as integral molded projections of the wall.

Furthermore, it is preferred that locking can be carried out at different heights. Thus, an adaptation of the height of the locked shipping container to the goods filled into the shipping container is easily possible.

With regard to the locking element itself, it is fundamentally possible to use rods, at first. For example small rods that only perform one locking procedure, in each instance, and are clearly smaller in their length than a width dimension of the assigned wall of the container. However, it is preferred in this regard that the locking is provided by means of a locking part that is flexible crosswise to the locking direction. This is because what is essential is locking to prevent the parts from being pulled apart in the vertical direction. If, on the other hand, a locking part that is flexible crosswise to the locking direction is used, the locking mechanism practically cannot be impaired by the aforementioned transport stresses, in this regard. After all, it is essential that loosening of the locking mechanism at the unloading site, without greater effort, is always possible.

In this connection, it is particularly preferred that the locking part is a (steel) cable. A (steel) chain is also possible.

Independent of or supplemental to the locking part, it is furthermore preferred to provide a height setting part. In this way, a prior setting of the parts relative to one another can be achieved when first selecting the height at which the parts are locked together with one another. It is sufficient if this prior setting is made at one or two of the locking locations distributed in multiple locations around the circumference. Then the locking part, in other words the steel cable, for example, can be passed through the plurality of locking locations without having to additionally hold the parts with regard to their height position. In particular, in this connection, the height setting part can be a tube-like locking bar. The actual locking part, in other words the steel cable, can then be drawn through the tube. It therefore no longer has to be removed. Preferably, the flexible locking part, in other words the steel cable, for example, is also configured with such a length that it can completely loop around the container. Then, a special lever and setting mechanism is provided for fixing the steel cable in place; this will be explained in greater detail below.

The locking part preferably lies free, partially, over the circumference. In this connection, it is also preferred that the locking part is flanked by delimitation walls formed on, on one or both sides, at least in the regions that lie free. These delimitation walls are then situated above and below the locking part when the container is set up as usual. The connection between, the bottom, is of course also closed. The delimitation walls make an integral transition into the bottom. The locking element therefore lies (free only) radially on the outside in this sense. These delimitation walls can advantageously prevent engagement under the walls in the region of the locking part. With regard to the latter, the coverage of the parts in terms of height, in the locking state, is also of importance. This amounts to at least 10 cm, but preferably a multiple of this dimension. A delimitation wall can suitably be formed as part of a corrugation, in the manner of a thickened region, of the wall. This corrugation in the manner of a thickened region accordingly extends crosswise to the pushing direction. It forms a groove in which the locking element rests.

It is furthermore advantageous if the locking part surrounds the upper and lower part, respectively, alternately passing through a molded projection and lying free towards the outside.

The shipping container itself preferably has a rectangular outline and is preferably adapted to the dimensions of a Euro pallet. In this connection, for example in the one embodiment, in such a manner that a Euro pallet can be accommodated in the interior of the shipping container. In another embodiment, in such a manner that the outside dimensions of the shipping container correspond to those of a Euro pallet (footprint).

Furthermore, it is preferred that a reinforced bottom is formed on the lower part. This can be configured as a wood bottom, for example. Also, it is preferred that the lower part is configured in the manner of a Euro pallet on its underside. For this purpose, it is possible to use known plastic pallets that can be connected with the bottom, for example. This by means of a rivet connection, for example.

Furthermore, it is also preferred that a side wall of a part, preferably the lower part, can be taken out. In this connection, it is preferably provided, in detail, that the side wall can be fixed in place by means of vertically disposed locking rods. It is also possible for several side walls, for example side walls that lie opposite one another, to be removable. The locking rods are furthermore preferably secured on the side wall, so that they cannot get lost even during loading and unloading. Securing can again be provided by means of a steel cable. Also, one locking rod preferably runs in cropped manner, and is again secured on the side wall itself or on another wall of the upper or lower part, in its cropped region. Thus, security against being pressed out from below is made possible.

Figure 2:
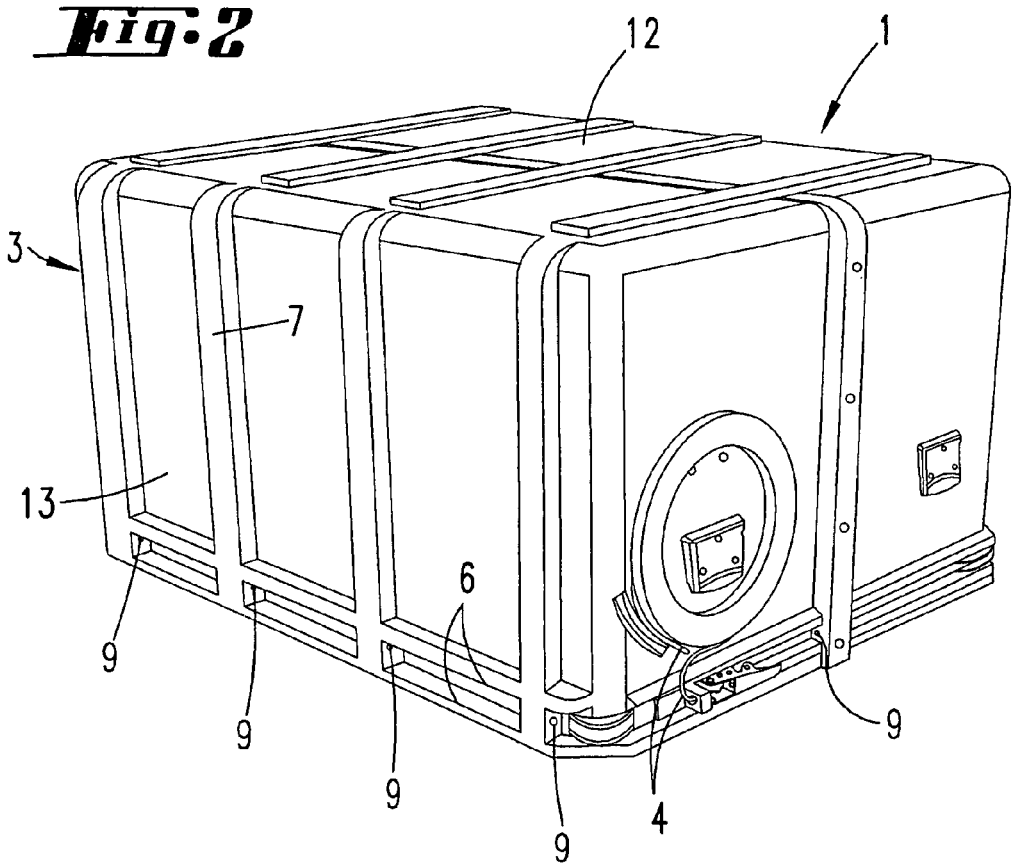
Figure 2:
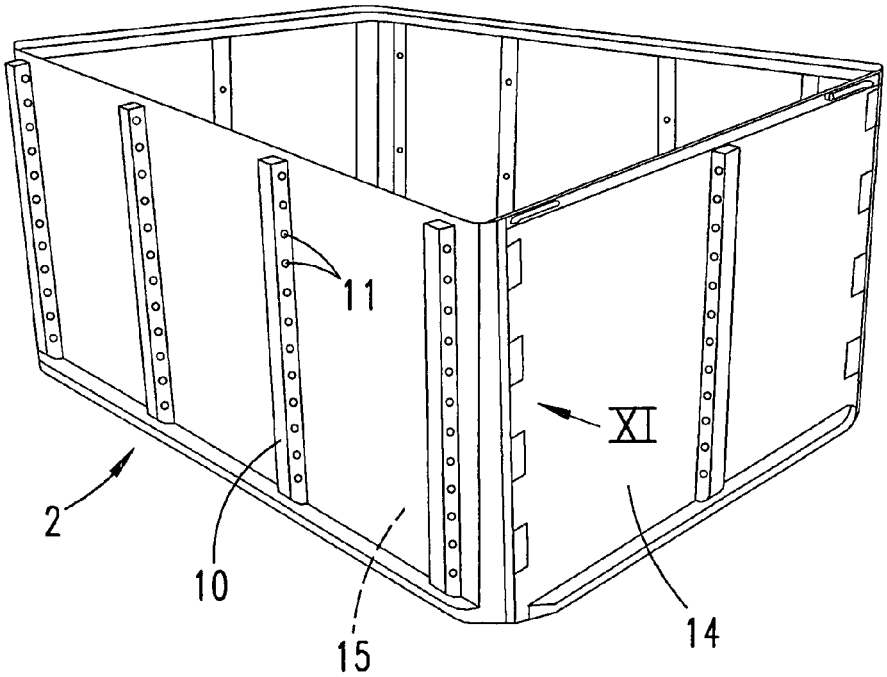
Figure 3:
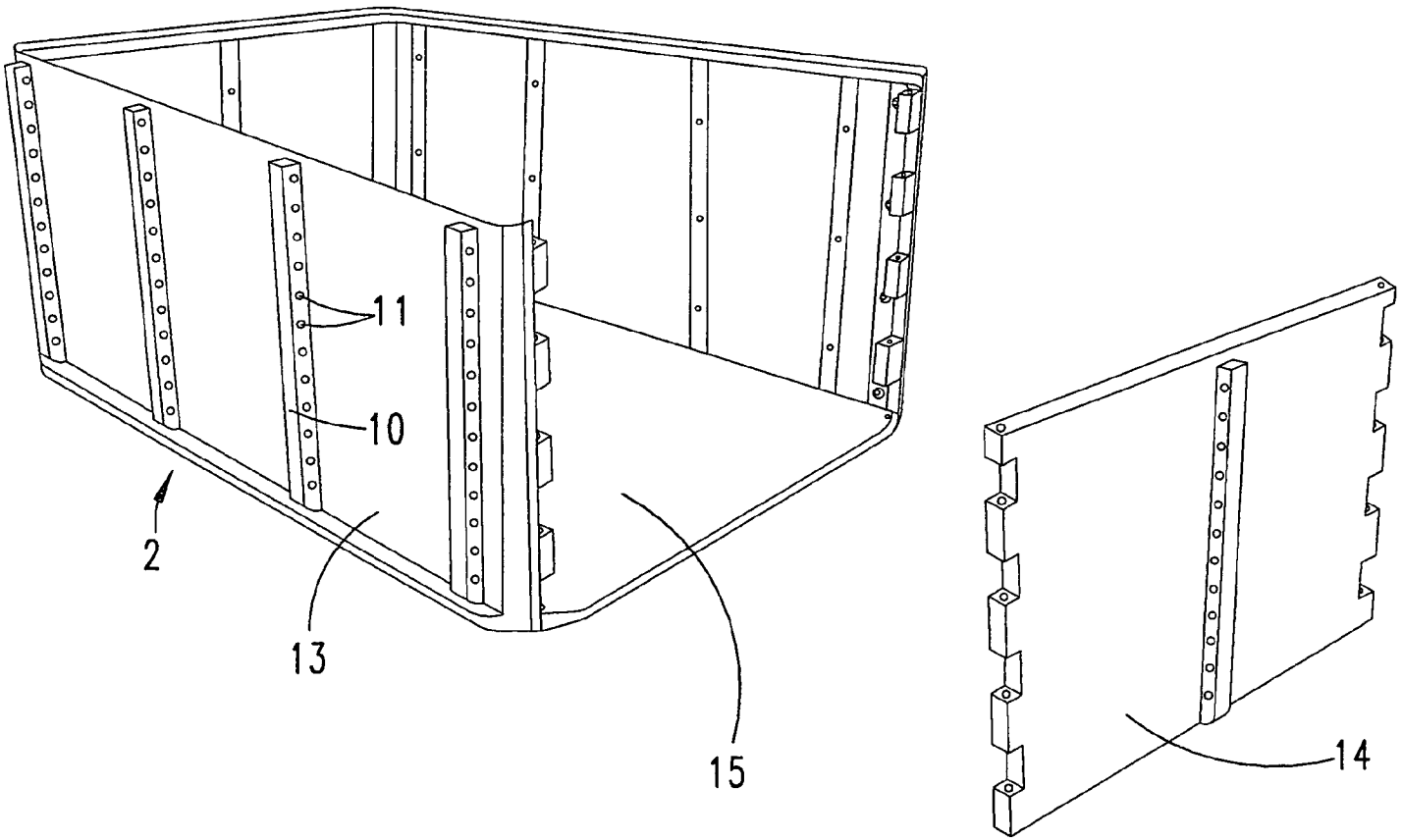
Figure 4:
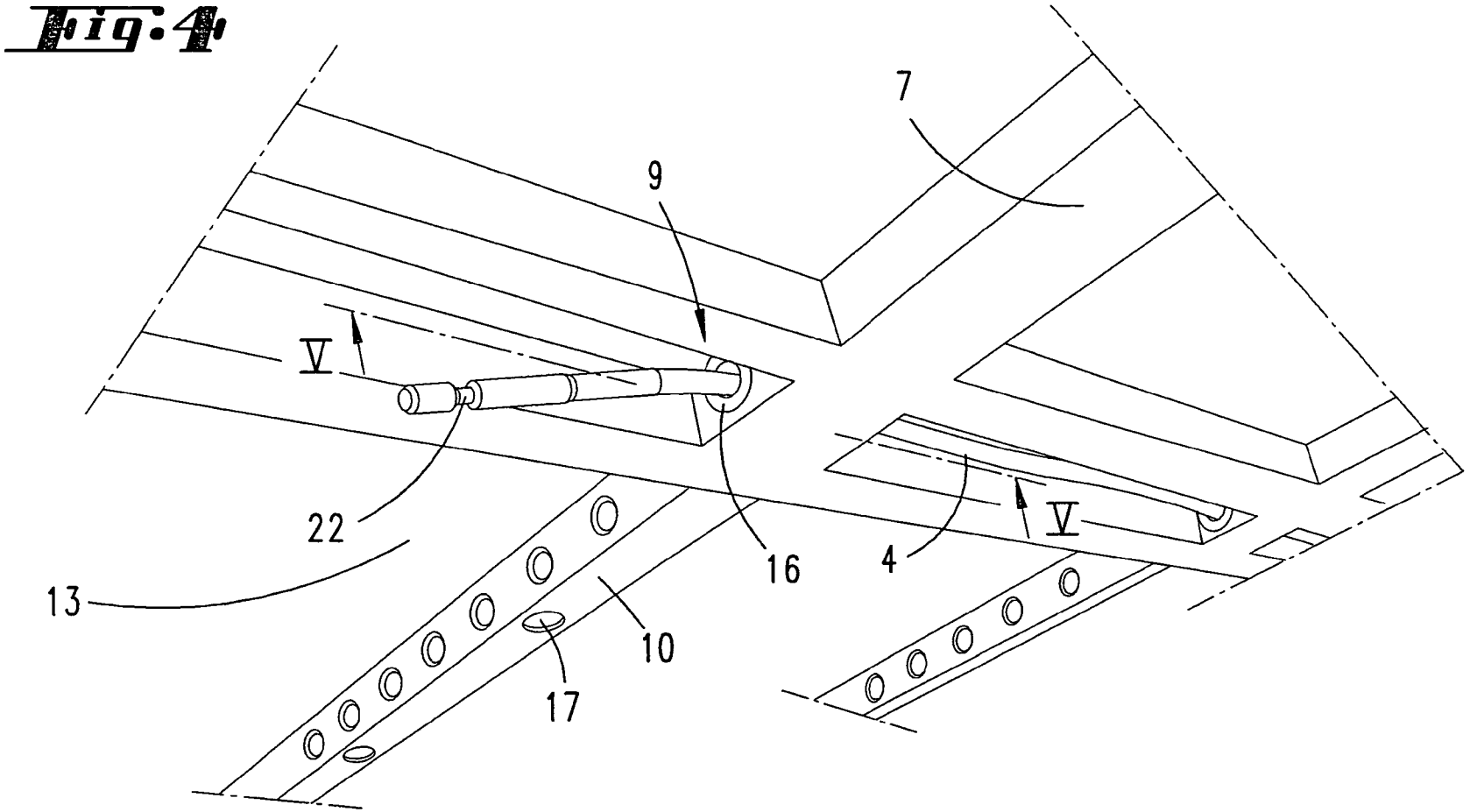
Figure 5:
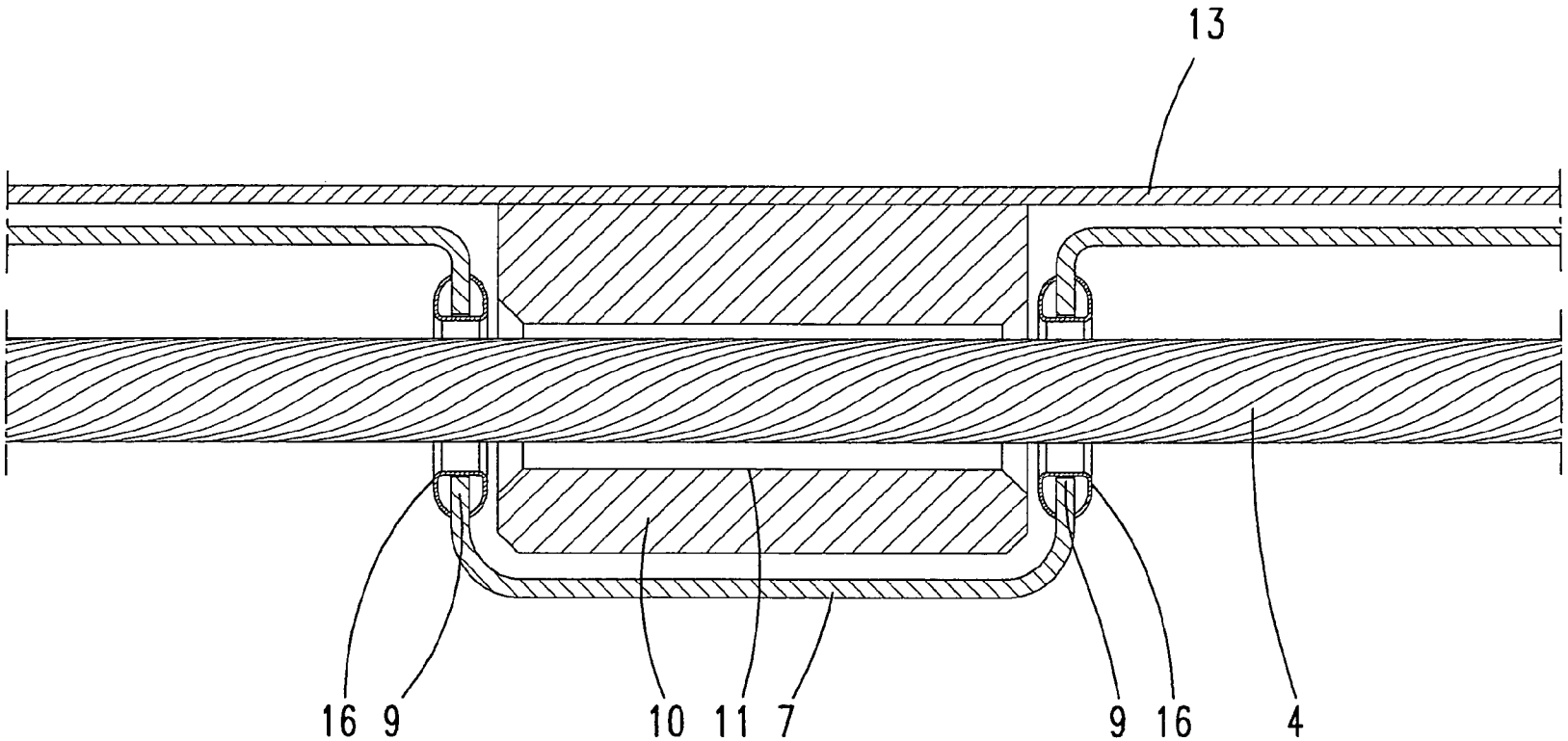
Figure 6:
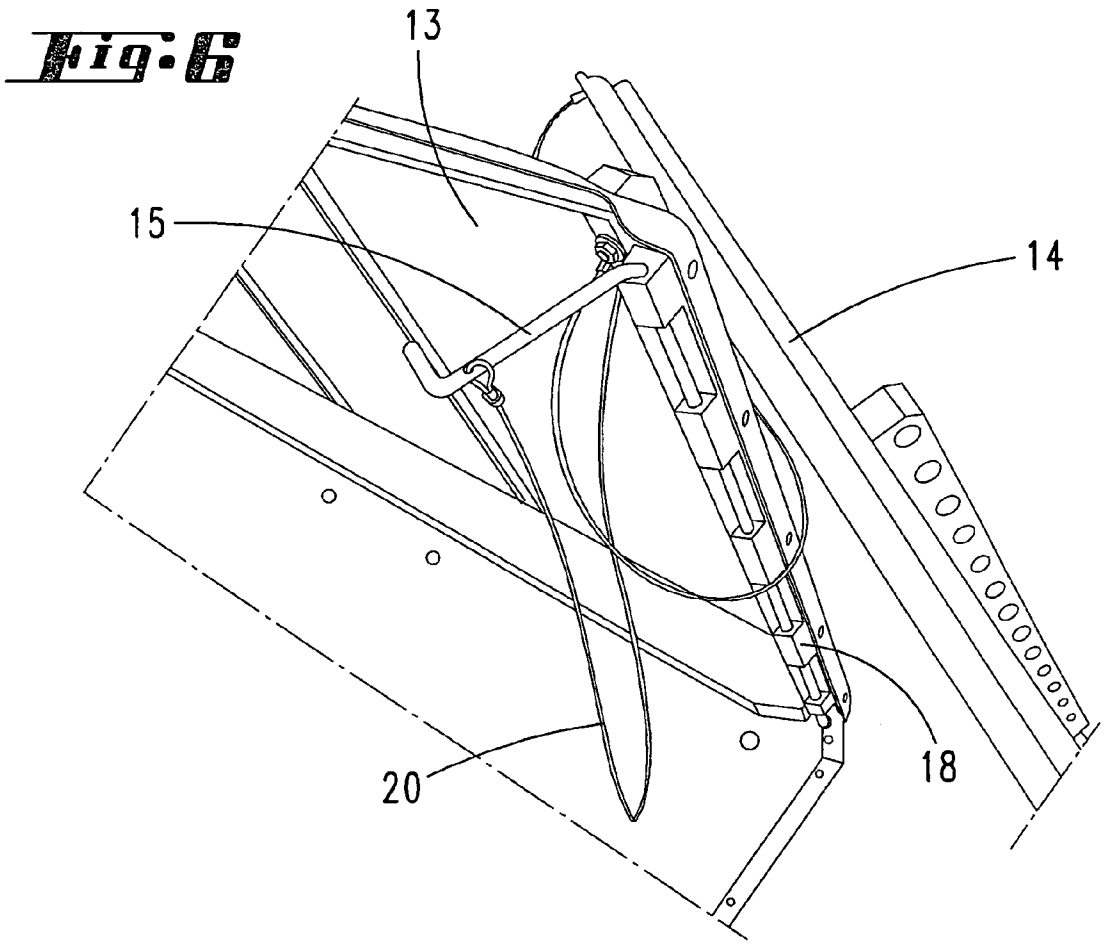
Figure 7:
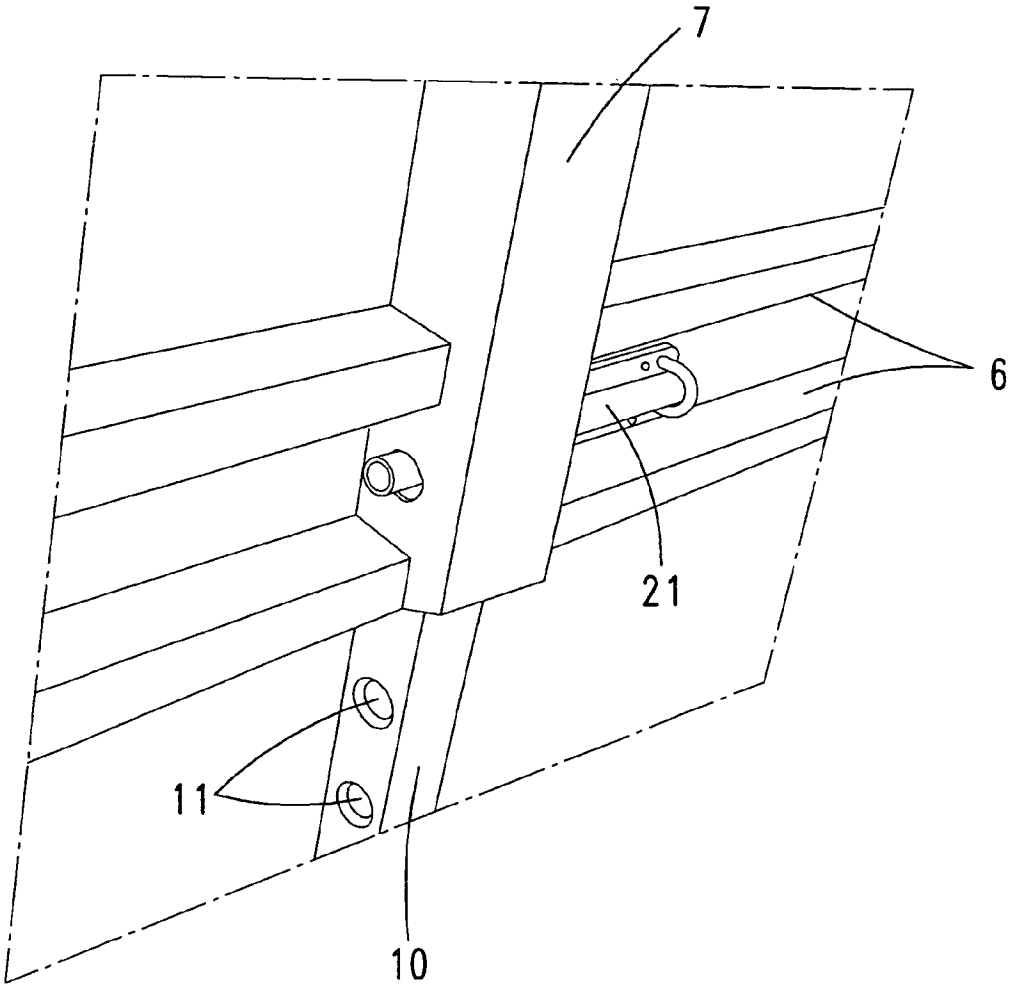
Figure 8:
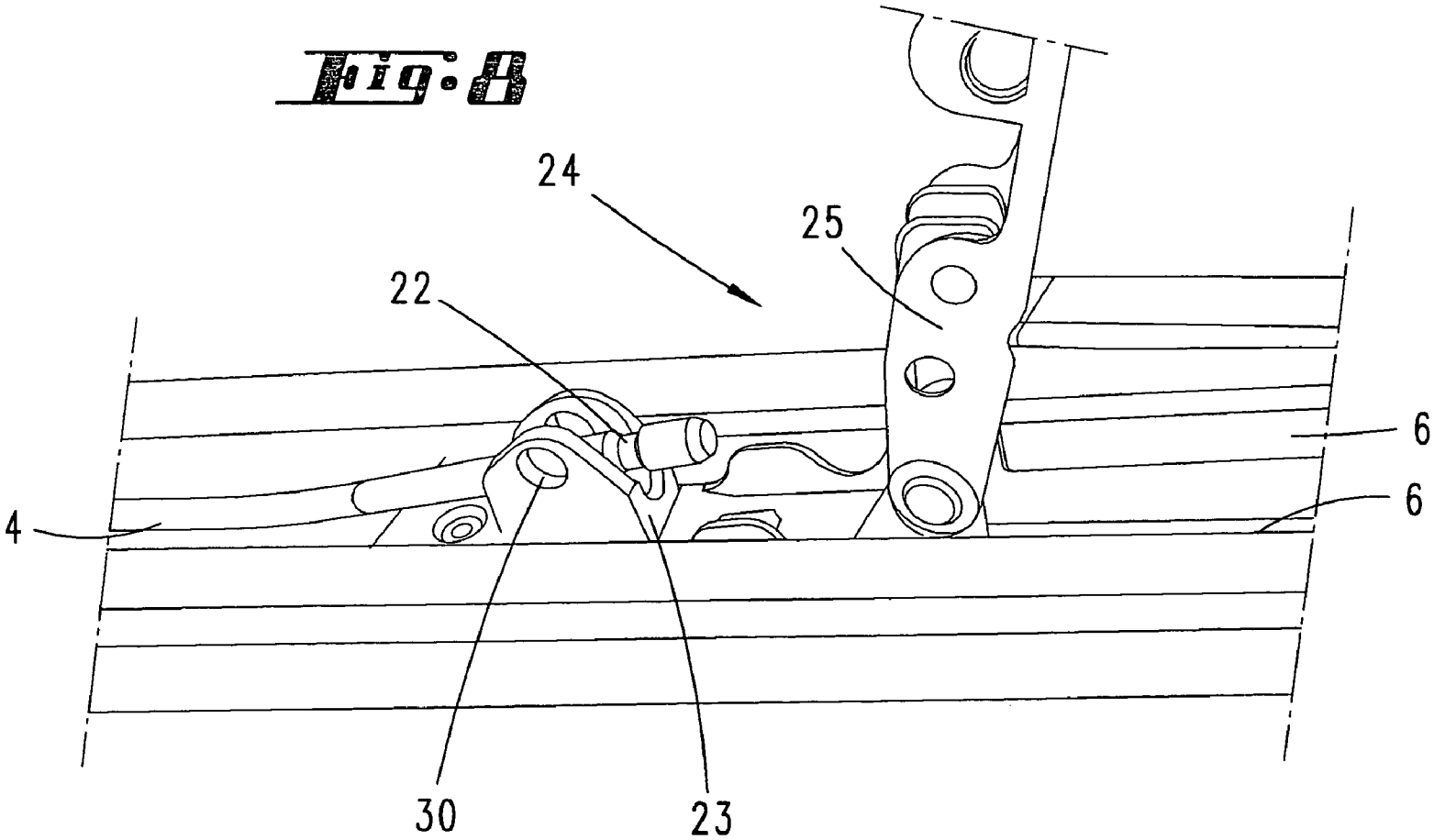
Figure 9:
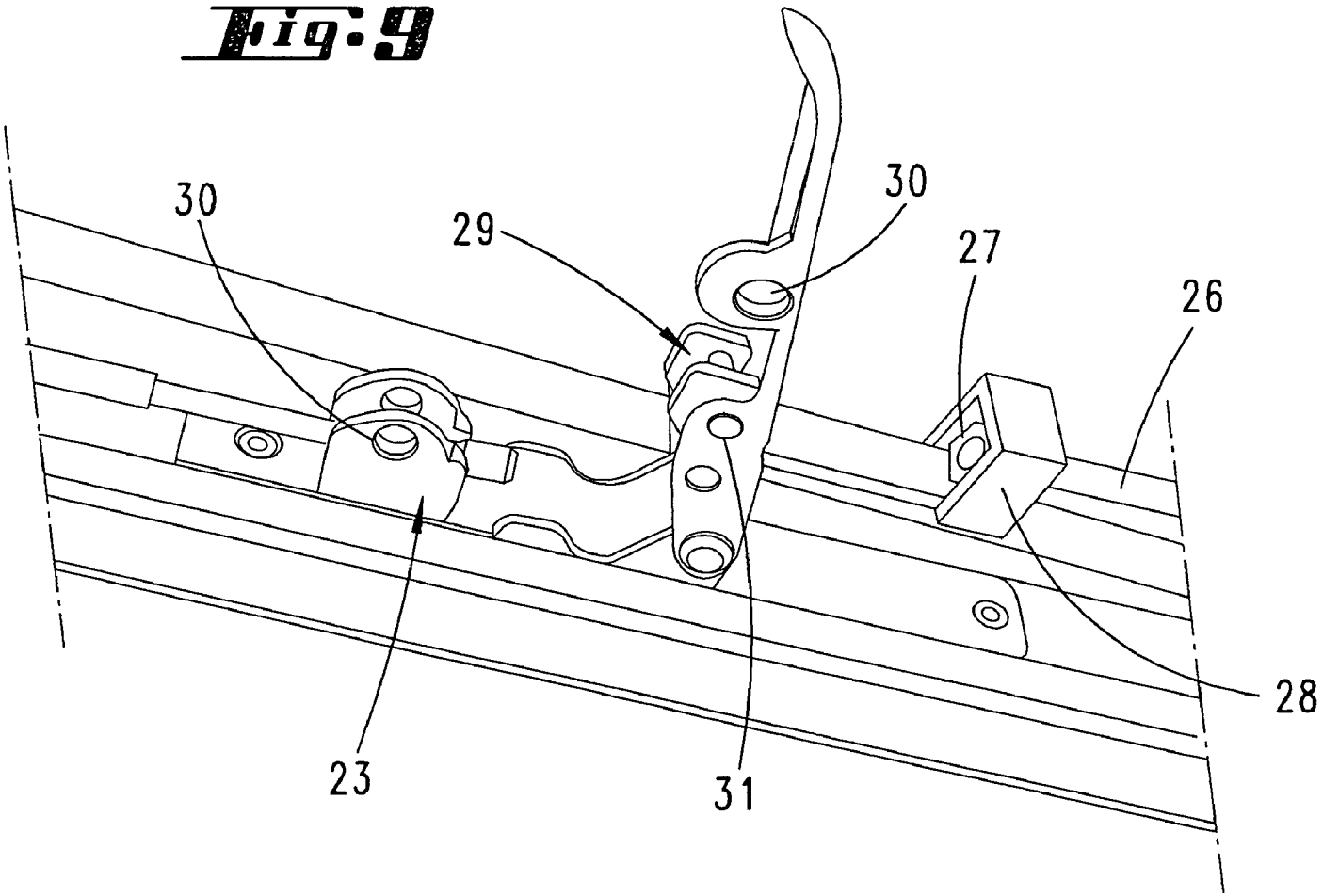
Figure 10:
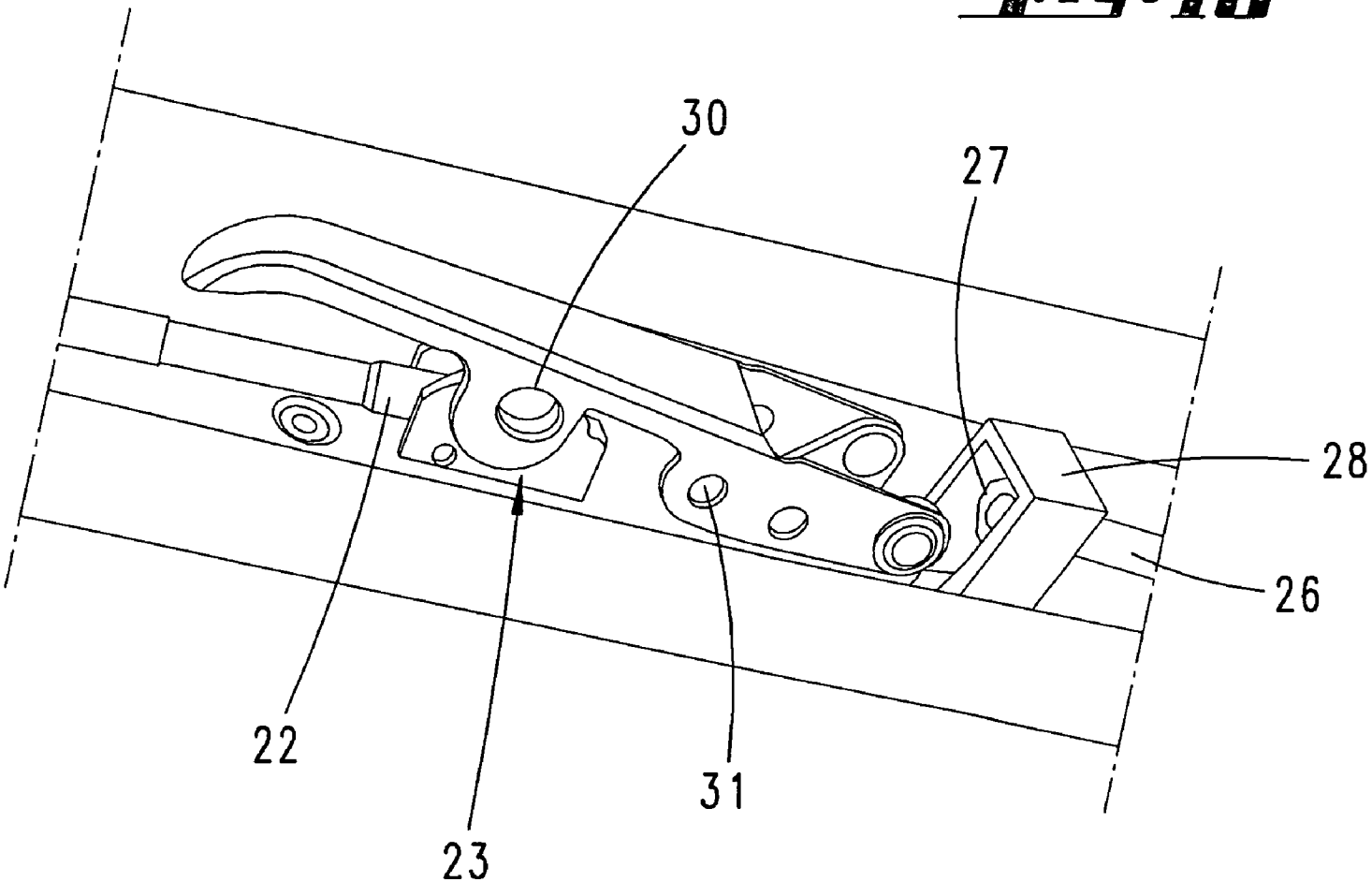
Figure 11:
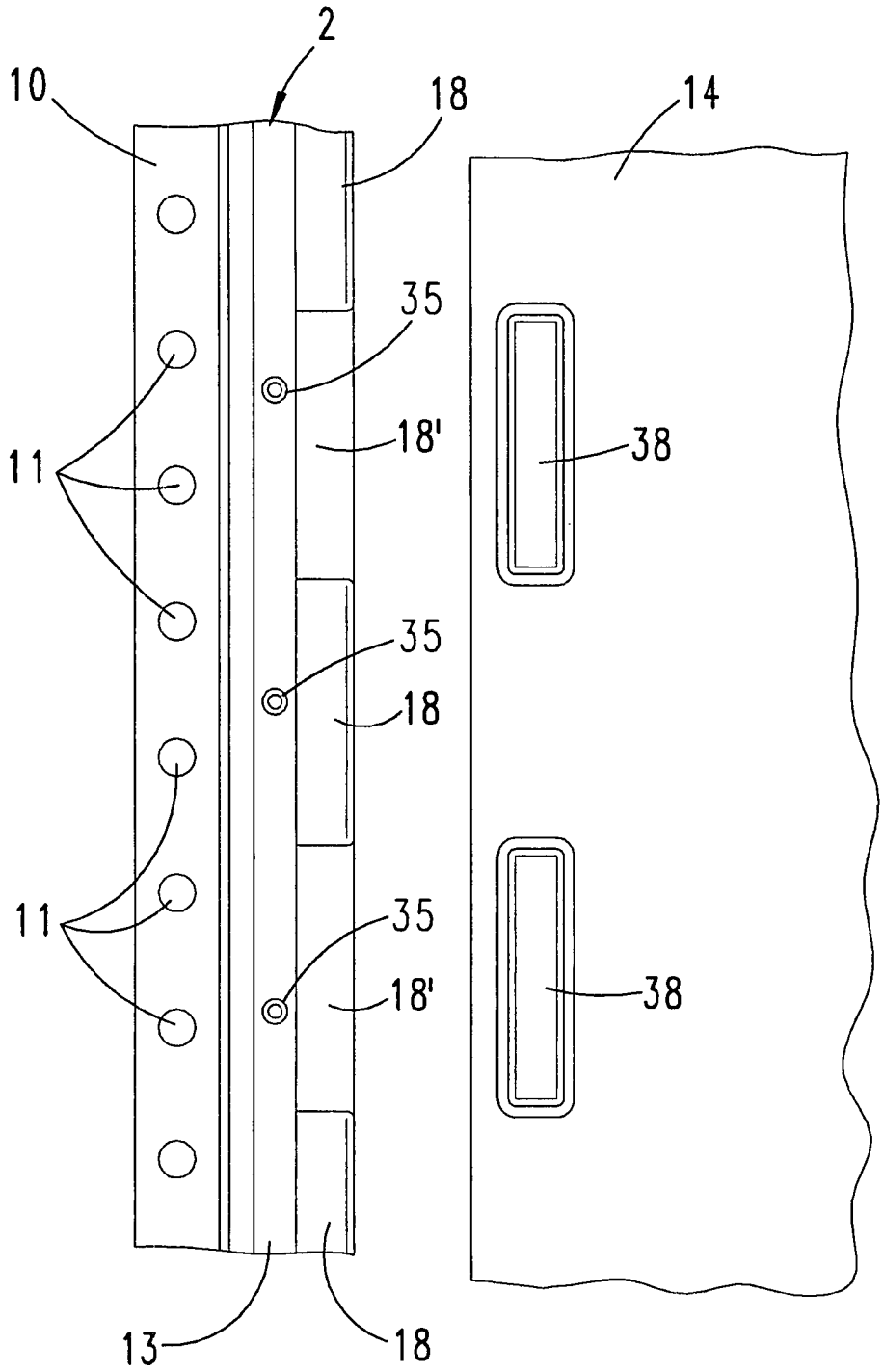
Figure 12:
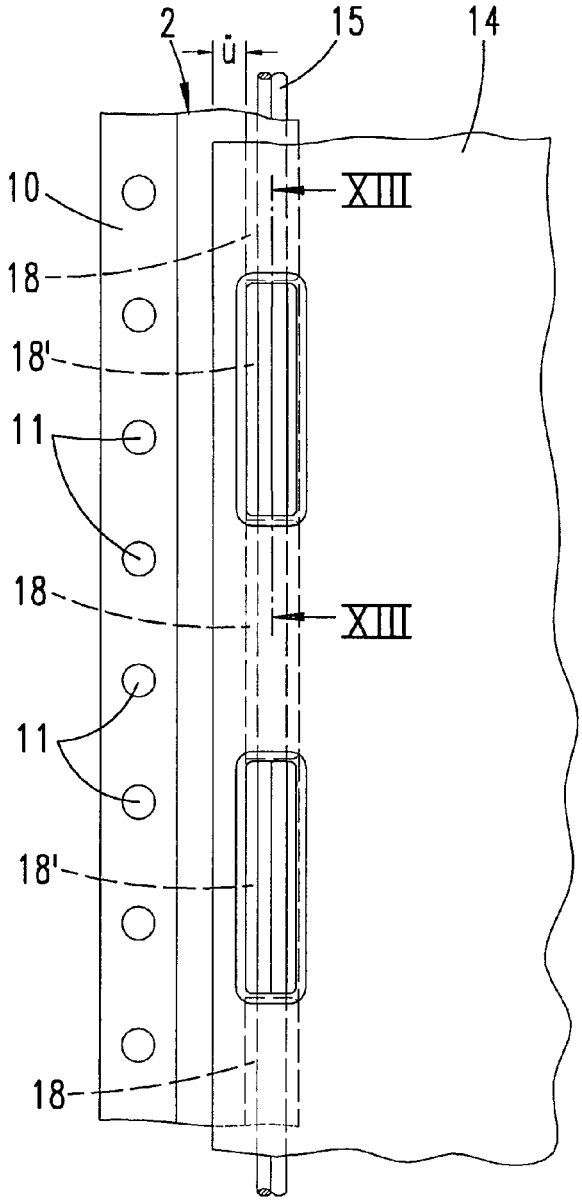
Figure 13:
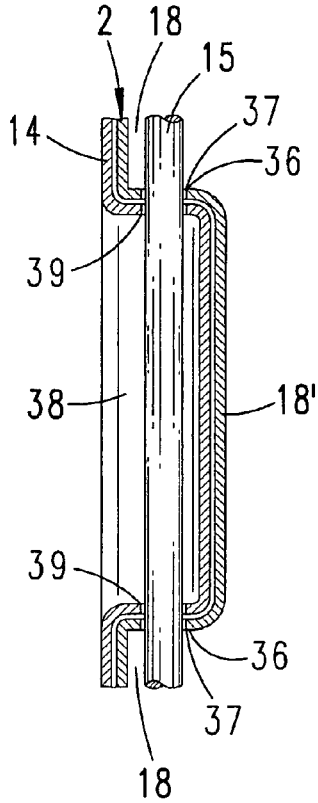

The invention will furthermore be explained below, using the attached drawing, which, however, shows an embodiment merely as an example. In this connection, the drawing shows:

FIG. 1 a perspective view of the shipping container, in the state in which the parts are pushed onto one another;

FIG. 2 the object according to FIG. 1 as an exploded view;

FIG. 3 a perspective representation of the lower part, with the side wall taken out;

FIG. 4 an individual representation when performing a locking procedure;

FIG. 5 a section through the object according to FIG. 4, cut along the line V-V;

FIG. 6 an individual representation with the side wall taken out;

FIG. 7 a perspective detail representation of an inserted height setting part;

FIG. 8 a perspective representation of the lever and setting mechanism;

FIG. 9 a representation of the object according to FIG. 8 in further activation;

FIG. 10 a representation of the object according to FIG. 8 and FIG. 9, respectively, almost closed;

FIG. 11 a detail representation of a side wall region of the container (lower part) with an assigned detail region of a removable side wall;

FIG. 12 a representation according to FIG. 11, in the inserted and locked state of the side wall, and FIG. 13 a cross-section through the representation according to FIG. 12, cut along the line XIII-XIII.

A shipping container 1 is shown and described, first of all with reference to FIGS. 1 to 3; it consists of an upper part 2 and a lower part 3. The parts are dimensioned in such a manner that they are disposed so that their bottoms 12 (upper part 3) and 15, respectively, face in opposite directions, and their free upper edges are moved over one another.

The offset V of the free edges relative to one another, in the overlap direction, preferably amounts to at least 10 cm.

In another detail, the parts 2, 3 are locked against one another at several locking locations 5, by means of a locking element 4 configured as a steel cable.

For this purpose, guides 6 that lie open towards the outside are implemented on the upper part 3, on the one hand, and passages 9 (see FIG. 4, 5) are implemented in the region of a vertical thickened region 7. In the region of the vertical thickened region 7, the upper part engages over a bar part 10 set onto the lower part in alignment with the vertical thickened region, in each instance, in which part bores 11 that match the passages 9 are formed.

Although the passages 9 in the upper part are provided to be circumferential at the same height plane, a plurality of bores 11 are provided in the rods 10 on a plurality of height planes.

Thus, upper part 3 and lower part 2 can be locked to one another in different heights.

The upper part and lower part consist, fundamentally, with regard to bottom 12 and walls 13, of a plastic shaped using the deep-drawing method. In the exemplary embodiment, the strips 10 are also plastic strips, produced from a solid plastic and using the injection-molding method.

While the thickened regions 7 and the guides 6 are made as an integral part of the wall of the upper part, the bar parts 10 are attached to a wall 13 of the lower part by means of rivets, in each instance.

In the lower part 2, a side wall 14 is disposed so that it can be taken out, as indicated in FIG. 3. Thus, for example, a pallet can be moved into the lower part 2, in simple manner, for example by means of a forklift, and then the side wall 14 can be inserted again.

In FIGS. 4 and 5, the reciprocal engagement of a vertical thickened region 7 with a rod 10 is shown in a further detail. The passage 9 can be seen in the vertical thickened region 7, supported by rivet-like covers 16.

The steel cable 4 is passed through.

In the exemplary embodiment, the rods 10 are attached to a wall 14 by means of screws 17.

In detail, it is evident from FIG. 6 that the side wall 14 is to be attached to an assigned wall 13 of the lower part, on both sides, by means of a locking rod 15, in each instance. For this purpose, forward convexities 18 are alternately formed in the wall 13, through which the locking rod 15 passes in the vertical direction. The wall 14 has its own projections, in accordance with the forward convexities 18, that fit into them, and the locking rod 15 then passes through them in the locked state, as well. This can be derived from FIG. 11 to 13 in a larger detail. The locking rod 15 is attached to the side wall 14 by means of a steel cable 20.

Independent of the locking part 4 configured as a steel cable, two height setting parts 21 are also provided, which are disposed on a front wall and a rear wall of the upper part, captured with regard to a thickened region formation 7.

This means that the height setting parts 21 are held on the container so as not to come loose. A tongue 32, shown schematically, serves for this purpose in the exemplary embodiment; it is firmly connected with the tube part. In the locked state shown, it lies against the outside wall of the vertical thickened region 7. In the open state, the tongue 32 lies against the bracket 33 or can be pushed up to it, in any case. Since the height setting element 21 is held on the upper part that forms the vertical thickened region, complete removal of the height setting part 21 is therefore not possible, even in the disassembled state of the parts. A height setting can be performed at first, when the parts 2, 3 are set on top of one another, by means of the height setting part 21; afterwards, the steel cable 4 is then drawn through the multiple locking locations.

With regard to the latter, it is shown in FIG. 4 that the steel cable is successively passed through the passages, over the circumference. The steel cable possesses a locking shape on its front end, formed by the narrowing 22. By means of this locking shape 22, the steel cable is placed into an accommodation 23 that is part of a locking handle 24 having a locking lever 25, after the cable has been looped around the entire shipping container, as is particularly evident from FIG. 8 to 10, for example. The opposite end 26 of the steel cable is constantly held captive by the locking lever 25. For this purpose, it has a hex nut 27 that is screwed onto a threaded end of the steel cable, in detail. This hex nut is accommodated in a capture housing 28 in such a manner that it does not permit rotation of the nut.

After the locking lever 25 is closed, there is a state in which the locking end of the steel cable is held down by the downholder 29. If a lock is furthermore placed through the openings 30 of the molded projection 23 and the lever 25 that lie on top of one another, as is generally provided, unlocking is no longer possible without opening the lock. Supplementally, a lead seal can also be provided, for example by means of lead-seal openings 31 provided for this purpose.

Making reference to FIGS. 11 to 13, the configuration of the removable side part 14 and its interaction with the opening in the container will be explained in greater detail.

The side view of FIG. 11 shows a detail of the front left corner 34 in FIG. 2 of the lower part, for example. The first rod 10 with the bores 11 of the side wall can be seen. It can also be seen that the molded projection, which will be described in greater detail below, attaches to the integral side wall (not visible further) of the container, for the locking connection with the removable side wall 14, by means of rivets 35.

In the exemplary embodiment, the connection molded projection Is now created by means of deep drawing of depressions 18', in comparison with the forward convexities 18. Furthermore, bores 37 are then formed in the transition wall regions 36 formed in this way, which accordingly extend horizontally in the exemplary embodiment, through which bores the locking rod 15 in the locked state extends, as shown in FIGS. 12 and 13, for example.

In the case of the removable side wall 14, pocket-like depressions 38 are formed, in the same manner, which were—subsequently—also provided with corresponding holes or bores 39 in the transition wall regions.

From FIG. 13, it is evident that the molded projections 18' and depressions 38, respectively, lie nested in one another in the locked state. This, and the overlap Ü that results with regard to the wall regions that run in a flat surface, cf. FIG. 12, ensures that the interior of the container continues to be protected from splashing water, to the greatest possible extent, despite the removable side wall 14.

All of the characteristics disclosed are essential to the invention (in and of themselves). The disclosure content of the related/attached priority documents (copy of the prior application) is hereby also included in the disclosure of the application, with its full content, also for the purpose of including characteristics of these documents in claims of the present application.

The invention claimed is:

1. Shipping container that can be used multiple times, having an upper part and a lower part having a bottom and walls, in each instance, pushed into one another, wherein the upper and lower parts can be locked against one another at a plurality of locking locations, whereby the locking locations are disposed distributed on the circumference of the upper part and the lower part, respectively, and wherein a locking part comprising a steel cable that is flexible at least crosswise to the insertion direction is provided for locking, wherein the upper part has first projections oriented in accordance with a pushing direction of the upper and lower part into one another, the first projections having first locking recesses, wherein the lower part has second projections oriented in accordance with the pushing direction, the second projections having second locking recesses, wherein the first projections and the second projections engage over one another;

wherein the first locking recesses match the second locking recesses, wherein the steel cable is insertable into the first locking recesses and is insertable into the second locking recesses, wherein the first locking recesses comprise passages arranged circumferentially around the upper part, the passages being located in a first height plane, and wherein the second locking recesses comprise a plurality of bores in the second projections, the plurality of bores being arranged vertically along the second projections in a sequential manner in a plurality of height planes.

2. Shipping container according to claim 1, wherein the locking locations are assigned to a locking plane that extends perpendicular to a pushing direction.

3. Shipping container according to claim 1, wherein the upper part and/or the lower part comprises a plastic material.

4. Shipping container according to claim 1, wherein the first and second locking recesses are oriented crosswise to the pushing direction for locking.

5. Shipping container according to claim 1, wherein the first and second projections include a molded projection structured as a bar part set onto a wall.

6. Shipping container according to claim 1, wherein the first and second projections include a molded projection formed integrally in a wall.

7. Shipping container according to claim 1, wherein the upper and lower parts can be locked against one another in a selectable height.

8. Shipping container according to claim 1, wherein a height setting part is provided independent of the locking part.

9. Shipping container according to claim 1, wherein the shipping container has a rectangular outline.

10. Shipping container according to claim 1, wherein the shipping container is adapted to the dimensions of a Euro pallet.

11. Shipping container according to claim 1, wherein a reinforced bottom is formed on the lower part.

12. Shipping container according to claim 1, wherein the lower part is formed in the manner of a Euro pallet on an underside of the lower part.

13. Shipping container according to claim 1, wherein a side wall of at least one of the upper and lower parts can be taken out.

14. Shipping container according to claim 13, wherein the side wall can be fixed in place via vertically disposed locking rods.

15. Shipping container according to claim 1, wherein the walls of the upper and lower parts have a flexibility that absorbs transport stress without lasting deformation.

16. Shipping container according to claim 1, wherein a cable accommodation is formed on at least one of the upper and lower parts.

17. Shipping container according to claim 14, wherein the vertically disposed locking rods for the side wall are secured on the shipping container or on the side wall.

18. Shipping container according to claim 14, wherein a locking rod of the vertically disposed locking rods runs in cropped manner.

19. Shipping container according to claim 14, wherein each wall of the lower part comprises a set of forward convexities alternately formed in the wall and each side wall comprises a set of third projections fitting into an associated set of forward convexities, each vertically disposed locking rod passing through a respective set of forward convexities in a vertical direction and through the set of third projections associated with the respective set of forward convexities in a locked state.

* * * * *